US006389842B1

(12) United States Patent
Telesz et al.

(10) Patent No.: US 6,389,842 B1
(45) Date of Patent: May 21, 2002

(54) ACCUMULATOR-DEHYDRATOR ASSEMBLY WITH ANTI-BUMP EXPANSION CHAMBER "J"-TUBE

(75) Inventors: John Paul Telesz, East Amherst; Timothy M. Gabel, Tonawanda; George Thomas Bennett, Williamsville, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/768,104

(22) Filed: Jan. 23, 2001

(51) Int. Cl.[7] ..... F25B 43/00

(52) U.S. Cl. ..... 62/503; 62/83; 62/513

(58) Field of Search ..... 62/503, 513, 83, 62/476; 55/463

(56) References Cited

U.S. PATENT DOCUMENTS

| | | | | |
|---|---|---|---|---|
| 4,291,548 A | * | 9/1981 | Livesay | 62/503 |
| 4,628,964 A | | 12/1986 | Sugimura et al. | 138/30 |
| 4,942,743 A | * | 7/1990 | Gregory | 62/503 |
| 5,052,193 A | * | 10/1991 | Pettitt et al. | 62/503 |
| 5,179,844 A | * | 1/1993 | Lyman et al. | 62/503 |
| 5,183,974 A | | 2/1993 | Wilhelm et al. | 181/5 |
| 5,735,313 A | | 4/1998 | Jenski, Jr. | 138/30 |

* cited by examiner

*Primary Examiner*—Denise L. Esquivel
*Assistant Examiner*—Melvin Jones
(74) *Attorney, Agent, or Firm*—Patrick M. Griffin

(57) ABSTRACT

An accumulator-dehydrator for use in an air conditioning system. The accumulator-dehydrator has a hollow delivery tube for delivering vaporized refrigerant and entrained oil to the compressor of the air conditioning system. The delivery tube has an expansion chamber and a separator to eliminate noise within the system.

10 Claims, 1 Drawing Sheet

ACCUMULATOR-DEHYDRATOR ASSEMBLY WITH ANTI-BUMP EXPANSION CHAMBER "J"-TUBE

TECHNICAL FIELD

This invention relates to an accumulator-dehydrator assembly for an air conditioning system. This invention specifically relates to an accumulator-dehydrator having a J-tube with an expansion chamber as part of the J-tube and a column separation feature as part of the J-tube.

BACKGROUND OF THE INVENTION

Vehicle air conditioning systems include a compressor that compresses and superheats refrigerant, which then runs through a condenser, expander and evaporator in turn before returning to the compressor to begin the cycle again. Mixed in with the refrigerant is a small amount of lubricating oil which is entrained within the refrigerant and is needed to ensure smooth performance of the compressor and to prolong the life of the compressor.

Interposed between the evaporator and compressor is an accumulator-dehydrator which is designed to accomplish several objectives. The accumulator-dehydrator primarily receives and accumulates the evaporator output effluent. The accumulator-dehydrator serves as a reservoir or separator in which fluid collects at the bottom and vapor at the top. The accumulator ensures that only refrigerant in a vapor stage passes to the compressor. The accumulator-dehydrator also prevents a liquid slug from being pulled or sucked into the downstream compressor. Still further, a desiccant is typically located in the bottom of the accumulator-dehydrator to absorb any water in the refrigerant.

Traditionally accumulator-dehydrators are known to use a U-shaped or

J-shaped tube more commonly known as a J-tube to collect liquid. The accumulator-dehydrator includes a canister with an inlet connected to the evaporator. The refrigerant enters the inlet as a vapor and liquid mixture. The liquid drops to the bottom of the canister and the vapor rises to the top. The J-tube is connected at one end to the canister outlet, which in turn is connected to the compressor. The J-tube extends down from the outlet to near the bottom of the canister and then turns upward and extends to near the top of the canister. The free end of J-tube, the portion near the canister top, is open to allow the vapor to be drawn into the J-tube and exit to the outlet to the compressor. A small opening is provided in the bottom turn-portion or U-portion of the J-tube to allow the liquid including the oil, to enter the J-tube and be entrained and delivered with the vapor to the compressor.

With traditional J-tube accumulator-dehydrators and the compressor disengaged (no flow through the J-tube), the J-tube will fill with liquid to the same level as the liquid in the canister. When the compressor is engaged a large pressure differential quickly occurs across the liquid stored in the J-tube. The large pressure differential causes the liquid in the J-tube to accelerate rapidly and to violently boil off. This rapid liquid acceleration and boiling imparts energy to the accumulator-dehydrator, which is classified as "bump" energy. This "bump" energy is present in all traditional J-tube accumulator-dehydrators. This energy manifests itself as a broad frequency noise known as the "bump".

The energy imparted to the accumulator-dehydrator is a function of the rate of pressure drop across the liquid level in the J-tube within the accumulator-dehydrator. The pressure drop is affected by the compressor displacement, compressor drive ratio, and the amount of internal volume on the suction side of the accumulator-dehydrator. The magnitude and occurrence of noise is dependent on the total energy imparted to the accumulator-dehydrator, the accumulator-dehydrator lines and the extent of accumulator-dehydrator isolation.

SUMMARY OF THE INVENTION

The accumulator-dehydrator of the present invention has a modified J-tube which contains an expansion chamber. The expansion chamber is a bulge on the J-tube with a predetermined volume. The expanded portion of the lower end of the expansion chamber starts at a point above the liquid line in the modified J-tube.

As part of the J-tube there is also a section of side wall which protrudes towards the center of the expansion chamber of the J-tube. This protrusion is called the column separation feature. The column separation feature directs any fluid moving through the J-tube into the expansion chamber. The column separation feature further helps eliminate any liquid slug from being expelled from the accumulator-dehydrator.

When the compressor starts its cycle and begins to draw refrigerant into the compressor the expansion chamber in the J-tube lengthens the time of the pressure drop upon engagement of the compressor. The velocity of the liquid extracted from the J-tube is decreased and the liquid begins to boil or flash much easier because the expansion chamber provides for more room and a lower pressure.

In the preferred embodiment, the accumulator-dehydrator of the present invention uses a J-tube, which is manufactured out of plastic. This allows for economical and cost effective manufacturing.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE PREFERRED EMBODIMENT

Figure 1:
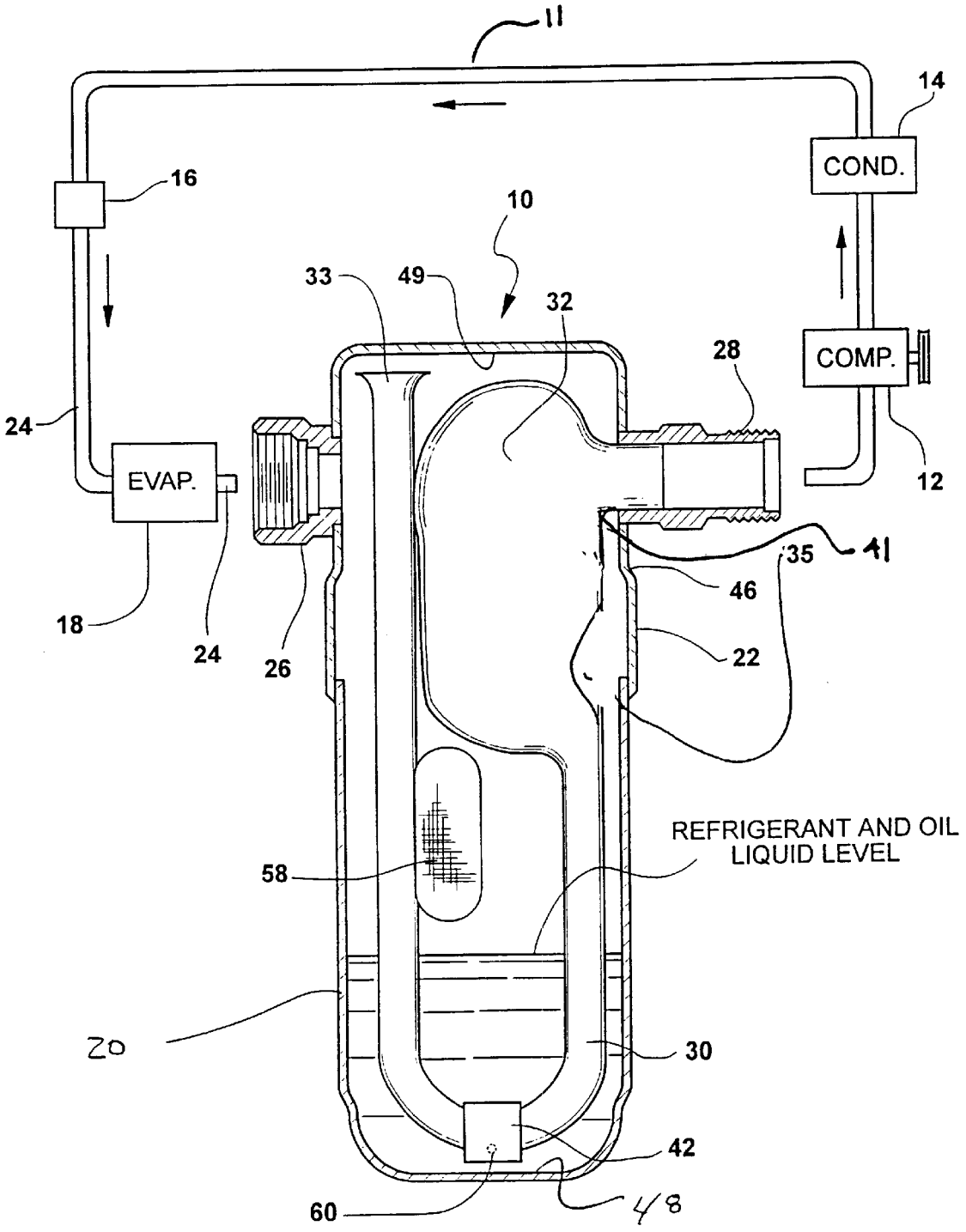
FIG. 1 is a schematic side view of the accumulator-dehydrator containing the J-tube showing the expansion chamber and column separation feature.

Referring to FIG. 1, the accumulator-dehydrator of the present invention is generally shown at 10. The accumulator-dehydrator includes a two piece casing having cup-shaped members 20,22 sealingly joined by an annular weld. These two cup shaped members 20,22 form a canister 21 when welded together. Inlet fitting 26 and outlet fitting 28 are attached near the top 49 of the canister 21. The accumulator-dehydrator 10 is connected through the fittings 26 and 28 to the refrigerant line 24 between the evaporator 18 and compressor 12.

The air conditioning system is shown schematically at 11 and includes compressor 12 and evaporator 18 as well as condenser 14 and value 16.

Liquid and vapor refrigerant enter the accumulator-dehydrator through the inlet fitting 26. Vaporous refrigerant collects at the top 49 of canister 21 and liquid refrigerant collects at the bottom 48 of canister 21.

A delivery tube or J-tube 30 is mounted internally in canister 21. The J-tube is affixed to the outlet fitting 28 located near the top 49 of the canister. J-tube 30 has a flared opening 33 to draw in vaporized refrigerant from the upper portion of canister 21. Mounted on the bottom of the J-tube 30 is a filter screen assembly 42. Refrigerant and oil flow through the filter and into the J-tube 30 through a small hole 60 located in the bottom of the J-tube 30. The liquid levels in the J-tube 30, and in the canister 21, are generally at the same level when the air conditioning system is idle. The J-tube may or may not include a pressure equalization hole 41. Pressure equalization hole 41 is preferably located between the outlet 36 and the sidewall of the canister 21. The pressure equalization hole equalizes the pressure in the J-tube 30 with that in the canister 21. This arrangement insures that if liquid does accumulate in the J-tube, it will not be pulled into the compressor by refrigerant migration.

Expansion chamber 32 is disclosed as a large chamber, which protrudes away from the outer wall 31 of J-tube 30 into the canister 21. In the disclosed embodiment chamber 32 generally fills the space within the upper portion of canister 21 between the inner walls 34 of J-tube 30. In this way, a greater volume of expansion can be achieved. The disclosed chamber 32 has an outlet 36, which is mechanically attached to outlet 28. As will be appreciated, other attachment methods could be used.

To help direct the liquid into the expansion chamber 32 there is a column separation feature 35. The column separation feature 35 is a protrusion that extends from the side wall 31 of the J-tube 30 into the main diameter of the J-tube 30 in the direction of the expansion chamber 32. As the suction of the compressor pulls liquid (both oil and refrigerant) from the reservoir into the J-tube the column separation feature 35 helps stop a liquid slug from being passed on to the compressor 12. The column separation feature 35 interferes with and directs any liquid flowing upward into the center of the expansion chamber away from the outlet 28 of the canister 21. This redirection assists in the vaporization of the liquid by dispersing the liquid towards the large compartment of the expansion chamber 32.

In the disclosed embodiment, a desiccant shown generally at 58 is provided to absorb moisture within the canister 21. As illustrated, the desiccant 58 is mounted above the refrigerant and oil liquid level to absorb moisture from the vaporized refrigerant.

The invention has been described in an illustrative manner, and it is to be understood that the terminology, which has been used, is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An accumulator-dehydrator for use in an air conditioning system having an evaporator and compressor interconnected by a refrigerant line containing refrigerant, said accumulator-dehydrator comprising:

a canister having an upper portion and a lower portion, said lower portion being adapted to receive liquid refrigerant and oil from said refrigerant line and said upper portion being adapted to contain vapor refrigerant, said canister having an inlet connected to said evaporator through said refrigerant line and an outlet connected to said compressor through said refrigerant line;

a hollow delivery tube in fluid communication with the lower end of said canister having first and second open ends, said first end positioned within the upper portion of said canister to draw in vaporized refrigerant, said second end connected to said outlet to deliver vaporized refrigerant to said compressor, said delivery tube drawing in liquid refrigerant and oil from said lower portion for delivery to said outlet;

said hollow delivery tube including an expansion chamber for reducing the velocity and momentum of the liquid refrigerant that is in said delivery tube at compressor start allowing some of this liquid refrigerant to vaporize for delivery to said outlet.

2. The accumulator-dehydrator of claim 1, wherein said delivery tube is generally j-shaped having a first leg, a bottom and a second leg.

3. The accumulator-dehydrator of claim 2, wherein said expansion chamber protrudes from said second leg in the direction of said first leg.

4. The accumulator-dehydrator of claim 3, wherein said second leg terminates in said second end connected to said outlet.

5. The accumulator-dehydrator of claim 2, wherein said bottom of said J-tube extends into said lower portion of said canister and is in fluid communication with said lower portion.

6. The accumulator-dehydrator of claim 5, wherein said J-tube includes an aperture for drawing in liquid refrigerant and oil.

7. The accumulator-dehydrator of claim 1, further including a column separator protruding from said delivery tube and extending into said expansion chamber.

8. The accumulator-dehydrator of claim 7, wherein said expanding chamber has an entrance and exit, said column separator being adjacent to said entrance and said exit being adjacent to said outlet.

9. The accumulator-dehydrator of claim 8, wherein said column separator comprises an indentation formed in said delivery tube.

10. The accumulator-dehydrator of claim 7, wherein said hollow delivery tube has an inner wall and outer wall, said expansion chamber protrudes from said outer wall and said separator protrudes from said inner wall.

* * * * *